US005719477A

United States Patent [19]

Tomihari

[11] Patent Number: 5,719,477

[45] Date of Patent: Feb. 17, 1998

[54] ELECTRON GUN FOR CATHODE RAY TUBE

[75] Inventor: Yoshinori Tomihari, Tokyo, Japan

[73] Assignee: NEC Corporation, Tokyo, Japan

[21] Appl. No.: 679,153

[22] Filed: Jul. 12, 1996

Related U.S. Application Data

[63] Continuation of Ser. No. 266,586, Jun. 28, 1994, abandoned.

[30] Foreign Application Priority Data

Jul. 1, 1993 [JP] Japan ..... 5-163372

[51] Int. Cl.[6] ..... G09G 1/04; G09G 3/10; H01J 29/58; H01J 1/16

[52] U.S. Cl. ..... 315/381; 313/310; 313/336; 315/169.4; 315/387

[58] Field of Search ..... 315/366, 169.4, 315/371, 381, 387; 313/422, 309, 310, 336, 351, 346 R

[56] References Cited

U.S. PATENT DOCUMENTS

| | | | |
|---|---|---|---|
| 3,665,241 | 5/1972 | Spindt et al. | 313/309 |
| 3,755,704 | 8/1973 | Spindt et al. | 313/309 |
| 4,070,691 | 1/1978 | Smith et al. | 348/809 |
| 4,178,531 | 12/1979 | Alig | 313/309 |
| 4,307,507 | 12/1981 | Gray et al. | 29/580 |
| 4,604,647 | 8/1986 | Peele | 348/809 |
| 4,940,916 | 7/1990 | Borel et al. | 313/309 |
| 4,973,890 | 11/1990 | Desjardins | 315/383 |
| 5,015,912 | 5/1991 | Spindt et al. | 313/495 |
| 5,103,145 | 4/1992 | Doran | 315/381 |
| 5,347,201 | 9/1994 | Liang et al. | 315/366 |

FOREIGN PATENT DOCUMENTS

| | | |
|---|---|---|
| 48-90467 | 11/1973 | Japan . |
| 3-208241 | 9/1991 | Japan . |

OTHER PUBLICATIONS

"IEEE Standard Dictionary of Electrical and Electronic Terms" 3rd Edition. p. 305.

*Primary Examiner*—Gregory C. Issing

*Attorney, Agent, or Firm*—Sughrue, Mion, Zinn, Macpeak & Seas, PLLC

[57] ABSTRACT

The electron gun with a field emission type cathode includes a substrate, a plurality of groups of cathodes disposed on the substrate, each group having a conically shaped electron-emitter, and gate electrodes each associated with each group of the plurality of groups of cathodes for causing the conically shaped electron-emitter to emit electrons by field emission. A control voltage can be applied independently to each group of the plurality of groups of cathodes, and also to the gate electrodes.

11 Claims, 5 Drawing Sheets

ELECTRON GUN FOR CATHODE RAY TUBE

This is a Continuation of application Ser. No. 08/266,586 filed Jun. 28, 1994 now abandoned.

BACKGROUND OF THE INVENTION

1. Field of the Invention

The invention relates to an electron gun for use with a cathode ray tube, and more particularly to such an electron gun having field emission type cathode.

2. Description of the Prior Art

FIG. 1 is a cross-sectional view of a conventional electron gun for use with a cathode ray tube (generally referred to as "CRT"). The electron gun 20 comprises cathodes 1R, 1G and 1B each having an electron emitter 8R, 8G and 8B and a heater 9R, 9G and 9B respectively, a control electrode 4, a shielding electrode 10, a focusing electrode 11, and an acceleration electrode 12 for finally accelerating electrons. In an oxide cathode widely used as a hot cathode, the cathodes 1R, 1G and 1B are heated by the heaters 9R, 9G and 9B up to its operating temperature, namely approximately 800 degrees centigrade, thereby thermoelectrons are emitted from the electron emitters 8R, 8G and 8B. The thermoelectrons emitted from the electron emitters 8R, 8G and 8B are emitted in beam through an area defined by an openings 4a of the control electrode 4, and focused by a prefocus lens formed between the shielding electrode 10 and the focusing electrode 11 and also by a main lens formed between the focusing lens 11 and the acceleration electrode 12. The thus focused electron beam impinges on a fluorescent substance disposed inside a screen panel to thereby emit light and form images thereon.

In the aforementioned conventional hot cathode in which the cathodes 1R, 1G and 1B are heated up by the heaters 9R, 9G and 9B, it takes a few seconds after a power supply is turned on until the cathodes 1R, 1G and 1B are heated up to its operating temperature and the electron emitters 8R, 8G and 8B emit electrons to thereby form images on a screen.

In addition, since the heaters 9R, 9G and 9B have to be heated up to a high temperature, the heaters 9R, 9G and 9B consume much of electrical power.

In the aforementioned conventional electron gun, the control electrode 4 and the shielding electrode 10 are spaced from the cathodes 1R, 1G and 1B by approximately 100–200 micrometers. These electrodes are fixed with glass support pillars. The glass support pillars are heated up to be softened during the assembling of the electrodes, and cooled down to a room temperature after the completion of the assembling. In actual operation of the electron gun, the electrodes are heated by thermal radiation emitted from the cathodes 1R, 1G and 1B, to thereby be deformed. This results that the spaces between the electrodes are varied to thereby change the electrostatic properties of the electron beam. Accordingly, when the electrodes are designed, it is necessary to take into consideration the displacement due to the thermal deformation of the electrodes during operation at a high temperature.

Recently household electrical appliances are required to save electrical power for operating them. Computers and office equipments are also required to do the same, and hence computers and CRT monitors for use of a terminal display are likely to be designed so that electrical power consumption is decreased. In order to satisfy the requirement of saving electrical power and avoid disadvantages brought due to the use of hot cathodes, it has been suggested to use a field emission type cathode in place of a hot cathode. For instance, Japanese Unexamined Patent Public Disclosures Nos. 48-90467 and 3-2 08241 suggest color picture tubes each using therein a field emission type cathode. A field emission type cathode is operable in a room temperature, and hence it is possible to avoid disadvantages of a conventional hot cathode generated due to the operation in a high temperature. In addition, a field emission type cathode needs no heater, and hence consumes no electrical power.

Hereinbelow will be explained a cathode ray tube (CRT) using a field emission type cathode. FIG. 2 is a cross-sectional view of the electron gun disclosed in Japanese Unexamined Patent Public Disclosure No. 48-90467. This electron gun is of type in which a field emission type cathode is used. Cathodes 1R, 1G and 1B include three circular cones or conical projections, and are electrically insulated with an insulation layer 5 from each other. Into the cathodes 1R, 1G or 1B is transmitted a brightness signal representing red (R), green (G) or blue (B). A gate electrode 3 comprises a thin metal layer having therein apertures 3a each disposed facing the circular cone of the cathodes 1R, 1G and 1B, and is provided a certain voltage for causing the circular cones 1R, 1G and 1B to generate a desired field emission current when the cathodes 1R, 1G and 1B receive brightness signals. The thus emitted electron beams pass through a control electrode 4, and then travel on the same orbit as that of a conventional electron gun to thereby focus images on a screen.

In the aforementioned color picture tube disclosed in Japanese Unexamined Patent Public Disclosure No. 48-90467 in which the cathodes 1R, 1G and 1B comprises three circular cones or conical projections, since the circular cones are minute-sized, more specifically, sized in the order of ten to several tens micrometers, there can be a dispersion in size of the conical projections due to errors in manufacturing. In particular, there can be a dispersion in size of a diameter of a tip of the conical projections which may greatly influence the electric field concentration. The gate electrode 3 is provided with a certain voltage which causes the cathode projections 1R, 1G and 1B to generate a desired field emission current when the cathodes 1R, 1G and 1B receive brightness signals. This voltage is greatly dependent on the size of the cathode projection, in particular dependent on the tip diameter of the cathode projection. Thus, if there is a dispersion in the tip diameter among the three cathode projections, there generates a difference in field emission current with the result that color balance on a screen is broken. In addition, the brightness signals are generally applied only to the cathodes 1R, 1G and 1B to obtain a field emission current, and hence it is necessary to provide quite large brightness signals for obtaining a field emission current larger than that of the cathodes.

However, recently a display for use of a computer and so on is required to represent images with high density and/or high precision, and accordingly, it is necessary to accomplish high speed scanning in which deflection frequency is modified to be a high frequency wave. To this end, a brightness signal having quite a short duration, specifically approximately several nanoseconds, is applied to the cathodes for scanning. However, there is a limit in scale in designing a circuit using brightness signals having such a quite short duration. In general, approximately 50 volts at most is applicable to such a circuit. Thus, a field emission current obtained from the cathodes is limited, and hence there arises a problem that a high brightness cannot be obtained on a screen.

SUMMARY OF THE INVENTION

It is an object of the present invention to provide an electron gun with a field emission type cathode which can overcome the aforementioned problems which the conventional electron guns have.

Another object of the present invention is to provide an electron gun with a field emission type cathode which can operate accurately even when there is a difference in control voltage to be applied to the three cathodes because of errors in manufacturing cathodes.

In one aspect, the invention provides an electron gun with a field emission type cathode, including a substrate, a plurality of groups of cathodes disposed on the substrate, each group having a conically shaped electron-emitter, and gate electrodes each associated with each group of the plurality of groups of cathodes for causing the conically shaped electron-emitter to emit electrons by field emission. Control voltages are able to be applied independently to each group of the plurality of groups of cathodes, and also to the gate electrodes.

In another aspect, the invention provides an electron gun with a field emission type cathode, including a substrate, a plurality of groups of cathodes disposed on the substrate, each group having a conical electron-emission source, gate electrodes each associated with each group of the plurality of groups of cathodes for causing the conically shaped electron-emitter to emit electrons by field emission, a voltage supply for applying a control voltage to each group of the plurality of groups of cathodes and to the gate electrodes associated with the each group, a detector for detecting a difference in the control voltage, and a controller for controlling the control voltage in accordance with the detected difference.

In a preferred embodiment, the electron gun has three groups of cathodes. Each group has a plurality of the conically shaped electron-emtitters.

In another preferred embodiment, a brightness signal for red, green or blue is provided to each of the three groups of cathodes.

In still another preferred embodiment, the plurality of groups of cathodes are electrically insulated from each other.

In yet another preferred embodiment, the gate electrodes are electrically insulated from each other.

In still yet another preferred embodiment, the control voltages applied to the plurality of groups of cathodes and the gate electrodes are synchronous voltages having opposite phases to each other.

In further preferred embodiment, the plurality of groups of cathodes and the gate electrodes are formed on a common single chip.

in further preferred embodiment, each set of the group of cathode and the gate electrode associated therewith is formed on different chips.

In further preferred embodiment, each group of cathode of the plurality of groups of cathodes is sized to have diameter equal to or smaller than approximately 0.4 mm.

In further preferred embodiment, the conically shaped electron-emitter is provided in the density equal to or more than $10^5$ numbers per 1 square millimeter.

In further preferred embodiment, each group of the plurality of groups of cathodes are sized to be smaller than the diameter of an opening of a control electrode.

The advantages obtained by the aforementioned present invention will be described hereinbelow.

As aforementioned, in accordance with the invention, the three cathodes for obtaining color picture can receive a control voltage independently from each other, and further the gate electrodes each associated with each of the cathodes can receive a control voltage independently from each other. Thus, even if there arises a difference in control voltage among the three cathodes because of errors in manufacturing cathodes, such a difference can be compensated for. In addition, it is possible to halve a signal voltage by applying brightness signals to the cathodes and the gate electrodes, which signals are synchronous ones having opposite phases to each other.

The above and other objects and advantageous features of the present invention will be made apparent from the following description made with reference to the accompanying drawings, in which like reference characters designate the same of similar parts throughout the drawings.

DESCRIPTION OF THE PREFERRED EMBODIMENTS

Preferred embodiments in accordance with the invention will be explained hereinbelow with reference to drawings.

Figure 1:
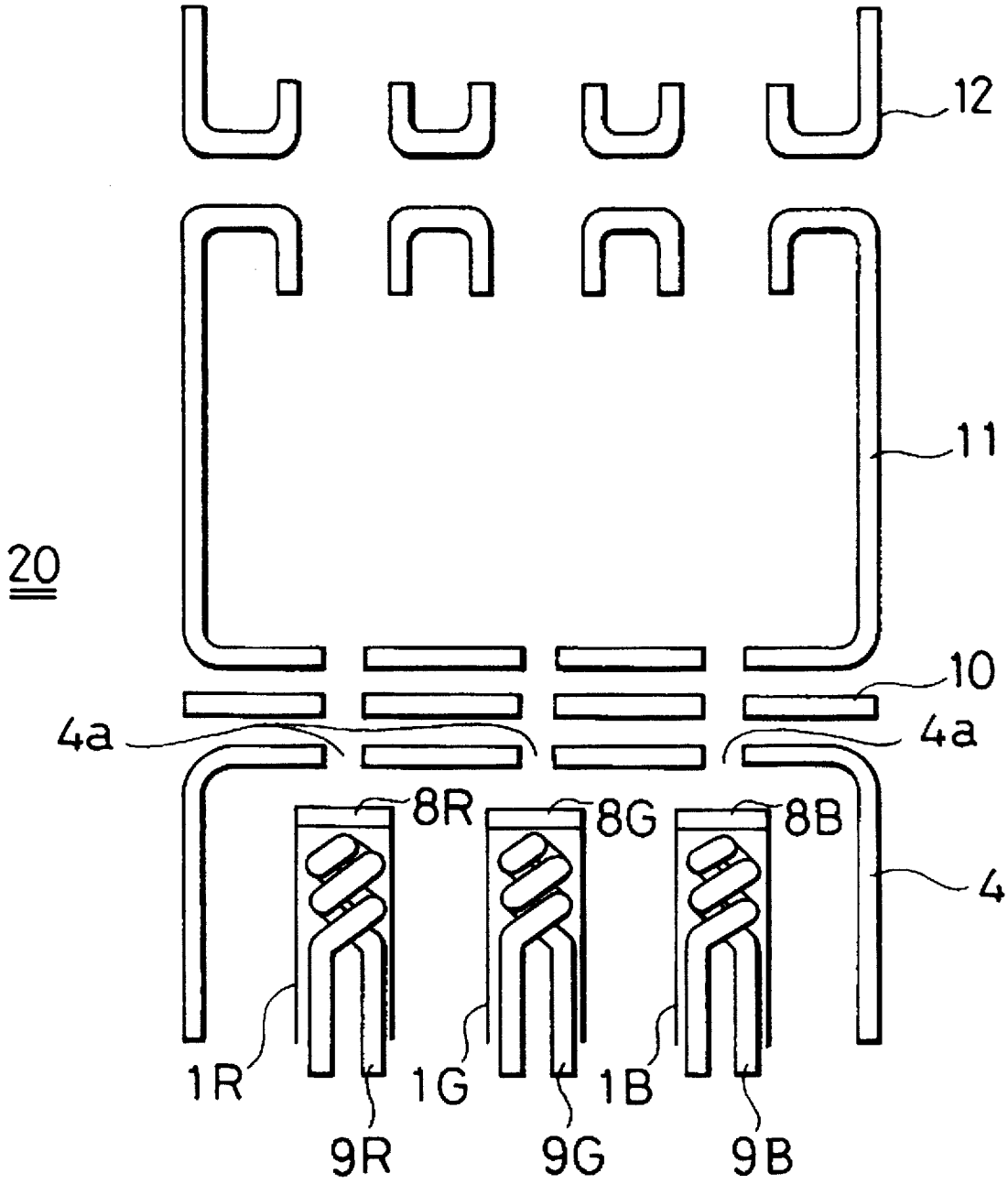
FIG. 1 PRIOR ART
FIG. 1 is a schematic cross-sectional view of a conventional electron gun for use with a cathode ray tube.
Figure 2:
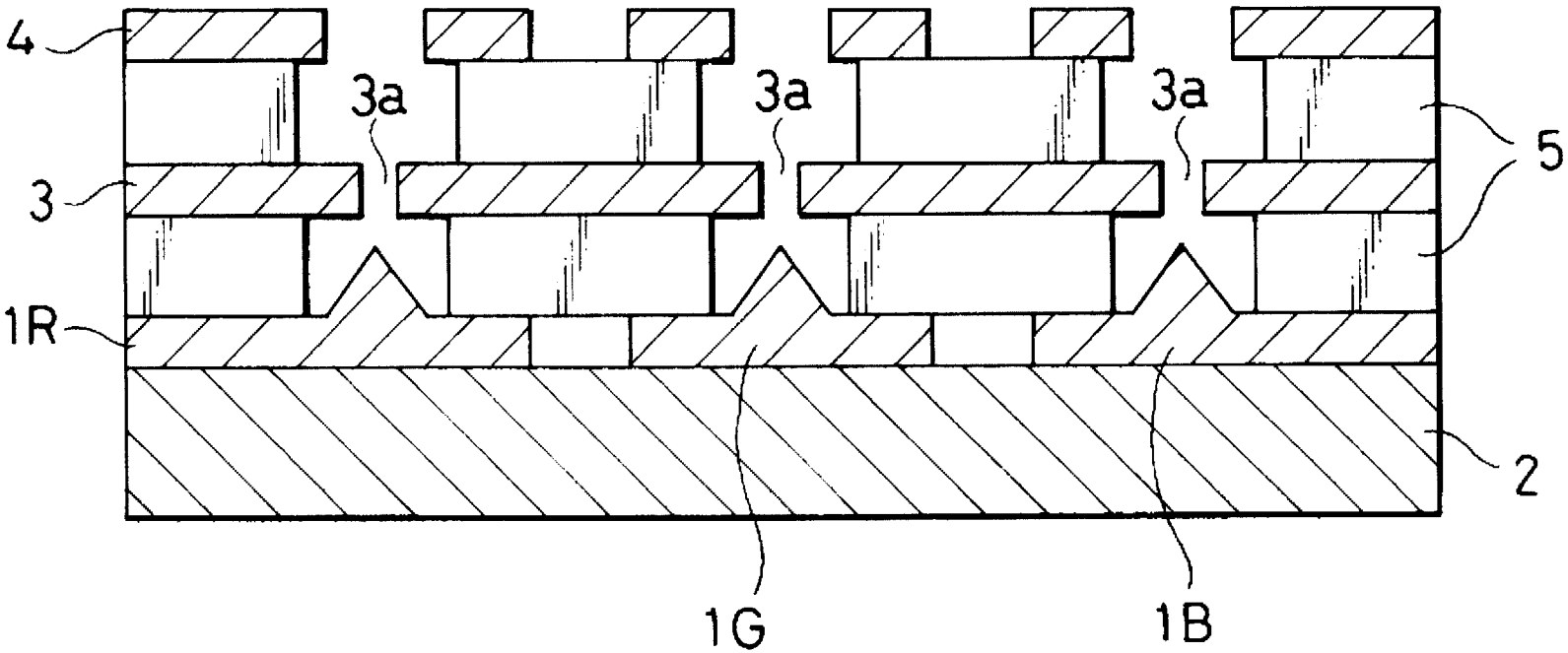
FIG. 2 PRIOR ART
FIG. 2 is a schematic cross-sectional view of the field emission type electron gun disclosed in Japanese Unexamined Patent Public Disclosure No. 48-90467.
Figure 3:
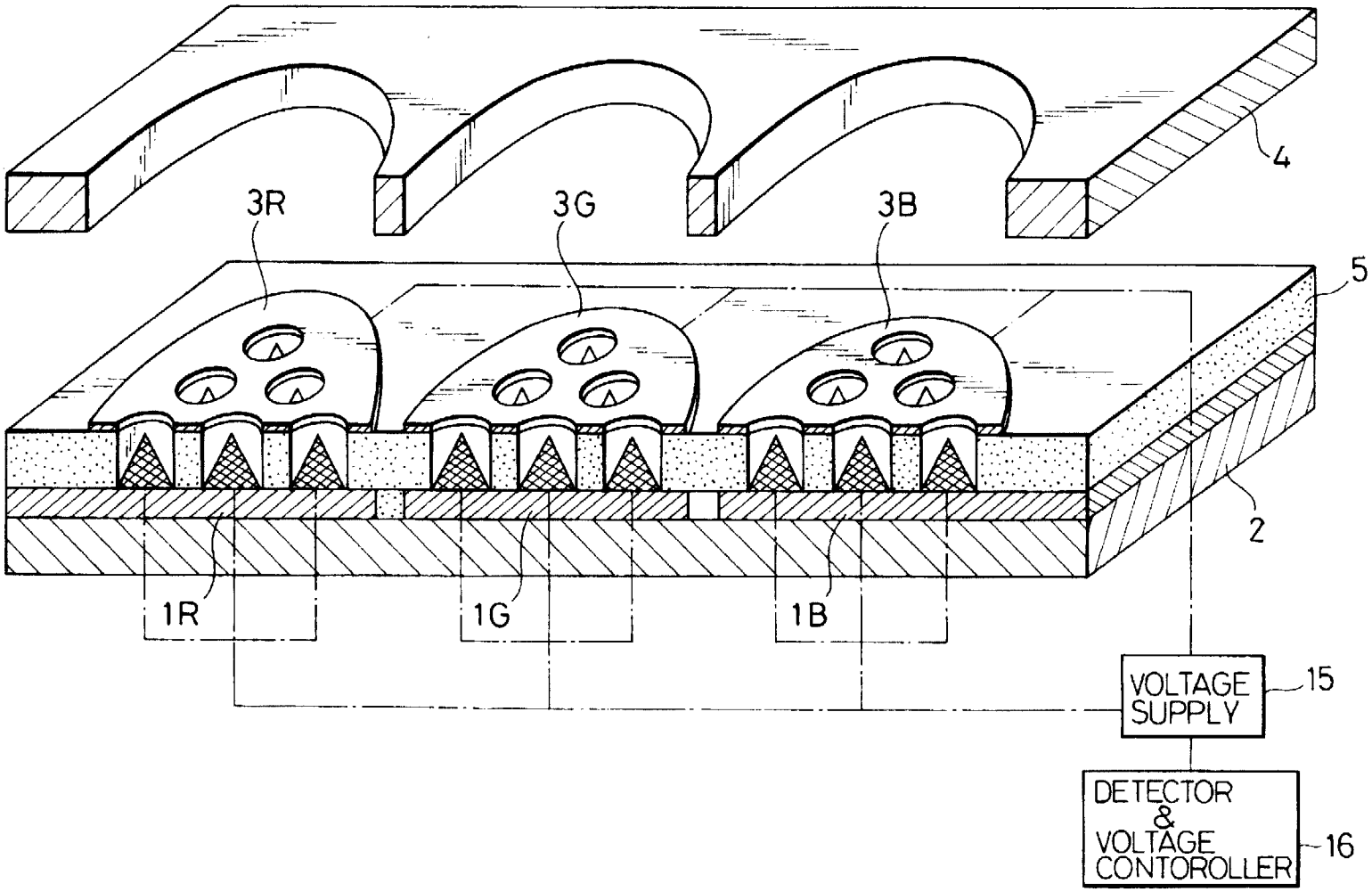
FIG. 3 is a schematic perspective view illustrating a first embodiment in accordance with the invention.

FIG. 3 is a cross-sectional view of an electron gun in accordance with the first embodiment of the present invention, in which the shielding electrode 10, the focusing electrode 11 and the acceleration electrode 12 as those illustrated in FIG. 1 are omitted. On an insulation layer 2 made of $SiO_2$ generated by thermal oxidation of silicon and formed on a substrate made of silicon, is disposed three groups of field emission type cathodes 1R, 1G and 1B each corresponding to red, green and blue pixels respectively. The three groups of cathodes 1R, 1G and 1B are electrically insulated from each other with an insulation layer 5 made of $SiO_2$, and hence to each of the groups of cathodes 1R, 1G and 1B can be applied a control voltage and a brightness signal independently from each other. The groups of field emission type cathodes 1R, 1G and 1B comprises a plurality of conically shaped electron-emitters which can be fabricated, for instance, by a method disclosed in U.S. Pat. No. 3,755,704 issued on Aug. 28, 1973 to Spindt et al., which is hereby incorporated by reference to extent that it is consistent herewith. Gate electrodes 3R, 3G and 3B disposed correspondingly to the groups of cathodes 1R, 1G and 1B respectively are electrically insulated from the groups of cathodes 1R, 1G and 1B, and hence to each of the gate electrodes 3R, 3G and 3B can be applied a control voltage and a brightness signal for causing the conically shaped electron-emitters to generate a field emission current.

Figure 4:
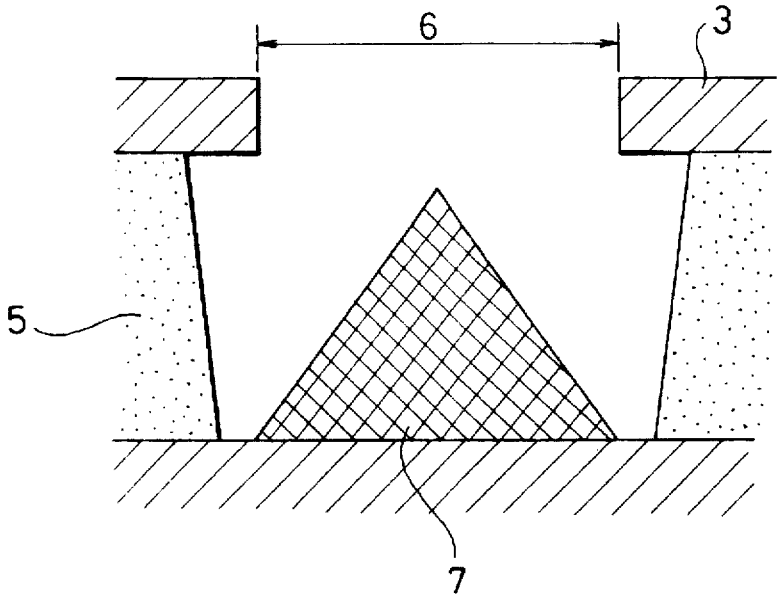
FIG. 4 is an enlarged cross-sectional view of the field emission type cathode.

Hereinbelow will be explained how the electron gun having the aforementioned structure is operated. In general, a field emission type cathode having a conically shaped electron-emitter as illustrated in FIG. 4 comprises a conically shaped electron-emitter 7 made of a semiconductor or metal such as Mo and Ta, and having a bottom surface having a diameter equal to or less than approximately 1 micrometer and a tip having a radius approximately equal to 20 nanometers; an insulation layer 5 made of $SiO_2$ and having a thickness of approximately 1 micrometer; and a gate electrode 3 made of Mo or W and formed on the insulation layer 5 and having openings having a diameter 6 equal to or less than approximately 1 micrometer correspondingly to the size of the conically shaped electron-emitter, and also having a thickness of approximately 0.4 micrometers.

In order to ensure that electrons can obtain electric field strength in the range smaller than $10^7$ V/m necessary for causing the conically shaped electron-emitters to emit electrons, it is necessary to hold approximately 100 volts (threshold voltage) between the cathode and the gate electrode. It should be noted that the threshold voltage is varied in dependence on the height of the conically shaped electron-emitter 7, the tip radius of the electron-emitter 7, the opening diameter 6 of the gate electrode 3 and so on. There can be quite a dispersion among dimensions of these due to errors in manufacturing. Thus, there can generate a difference in threshold voltage among the groups of cathodes 1R, 1G and 1B corresponding to red, green and blue pixels, and hence it is necessary to adjust voltages to be applied to the gate electrodes 3R, 3G and 3B. In the electron gun in accordance with the invention, since the gate electrodes 3R, 3G and 3B are electrically insulated from each other, it is possible to adjust the threshold voltage to thereby compensate for a difference in threshold voltage generated due to errors in manufacturing.

More specifically, as illustrated in FIG. 3, a voltage supply 15 is electrically connected to each group of the cathode groups 1R, 1G and 1B and provides a control voltage with the cathode groups 1R, 1G and 1B, and also with the gate electrodes 3R, 3G and 3B. The voltage supply 15 is electrically connected to a voltage controller 16.

The voltage controller 16 detects the above mentioned difference in threshold voltage among the groups of cathodes 1R, 1G and 1B, and thereby adjusts the control voltages to be applied to the gate electrodes 3R, 3G and 3B in accordance with the detected difference. Specifically, the control voltages to be applied to the gate electrodes 3R, 3G and 3B are increased or decreased by the difference detected by the voltage controller 16.

Recently, a display for use of a computer and so on is required to represent images with high density and/or high precision, and accordingly, it is necessary to accomplish high speed scanning in which deflection frequency is modified to be a high frequency wave. To this end, a brightness signal having quite a short duration, specifically approximately several nanoseconds, is applied to the cathodes for scanning. However, there is a limit in scale in designing a circuit using brightness signals having such a quite short duration. Since an amount of electrical current emitted from the cathodes are dependent on the voltage represented by the brightness signal, a desired brightness may not be obtained in the above mentioned high speed scanning in which deflection frequency is modified to be a high frequency wave.

Figure 5:
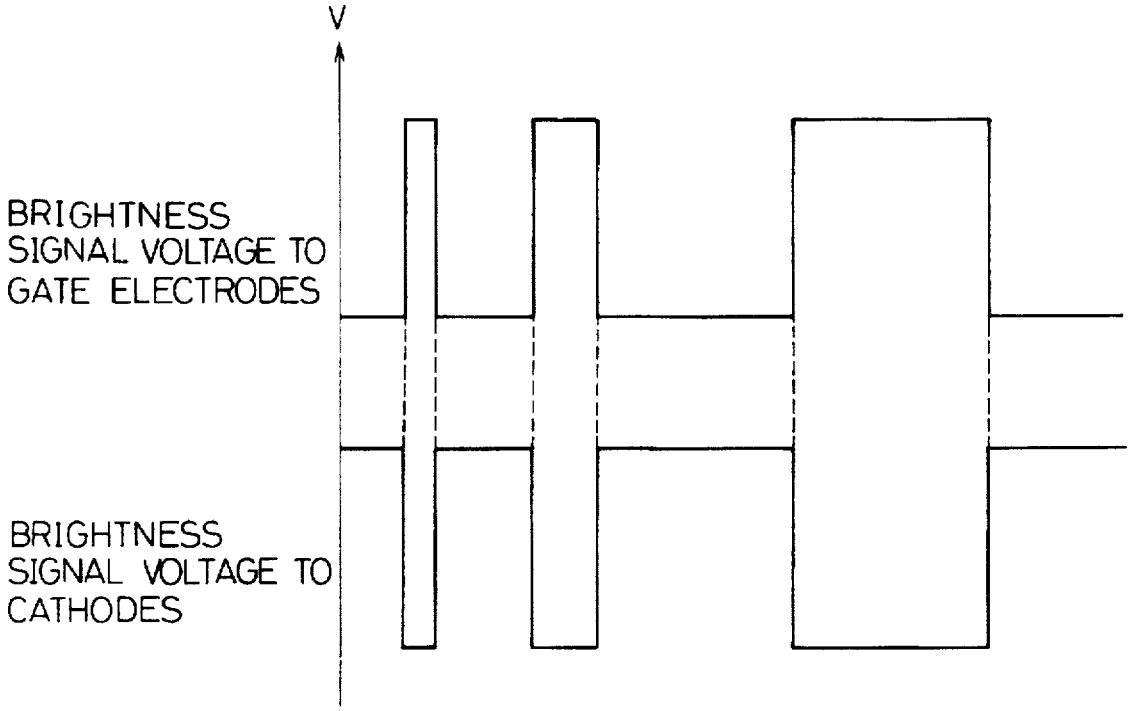
FIG. 5 illustrates an example of the wave forms of a brightness signal voltage to be applied to the electron gun in accordance with the invention.

The electron gun in accordance with the present invention can apply to the above mentioned problem. As illustrated in FIG. 5, brightness signals having opposite phases to each other are synchronously applied to the cathodes 1R, 1G and 1B and the gate electrodes 3R, 3G and 3B, thereby the electric field strength in the cathodes are apparently doubled and accordingly the obtained electrical current is increased in proportion thereto. Thus, it is possible to obtain the same brightness with half of the voltage, comparing to the case in which the brightness signals are to be controlled only with the cathodes. Accordingly, it is possible to scan the voltage beams without deteriorating the brightness even in high frequency areas in which the voltage beams could not conventionally be scanned. In scanning areas (15 to 30 kHz) for use of a television set and a computer monitor, the brightness signals may be applied either the cathodes 1R, 1G and 1B or the gate electrodes 3R, 3G and 3B.

In an electron gun using a field emission type cathode having a minute conically shaped electron-emitter, an orbit along which electrons travel have to be identical With an orbit along which electrons emitted from conventional hot cathodes travel. Accordingly, an area through which electrons emitted from the cathodes are radiated have to be quite small in hot cathodes, such an area is determined in accordance with a diameter of an opening of the control electrode 4, but not with the size of the cathodes. The diameter of an opening of the control electrode 4 is set to be approximately 0.4 millimeters in a monitor for use of a computer for ensuring resolution.

On the other hand, in a field emission type cathode, such an area as aforementioned is coincident with an area in which conically shaped electron-emitters and gate electrodes are formed, but not dependent on the size of the control electrode. Thus, when an electron optics system having conventional hot cathodes is to be used, it is necessary for the size of the electron-emitter to be equal to or smaller than 0.4 millimeters in diameter for converging electron beams on a screen into desired convergent beams.

The emission of electrons into an electric field from a conically shaped electron-emitter occur due to positive electric field which is generated between the electron-emitter and the gate electrode. Thus, if the area for conically shaped electron-emitters of the cathodes are larger than the diameter of an opening of the control electrode 4, electrons are led to the control electrode 4, and thus cannot travel along a desired electron orbit. Consequently, the diameter of an opening of the control electrode 4 has to be larger than the area for the conically shaped electron-emitters.

In the field emission type cathode having minute cortically shaped electron-emitters, each electron-emitter can provide an electrical current in the range of several tens microamperes at most. However, to cause a conically shaped electron-emitter to emit too much of electrons generates Joule heat, and the electron-emitter is heated by the Joule heat. This causes that the tip of the electron-emitter is forced to be rounded to thereby weaken the concentration of electric field at the tip of the cortically shaped electron-emitter with the result that it is no longer possible to obtain the emission of electrons by field emission. For the reasons above mentioned, in order to stably obtain the emission of electrons for a long time, it is necessary to maintain the electrical current equal to or smaller than 1 microampere per an electron-emitter, more preferably equal to or smaller than 0.1 microampere. In a typical cathode ray tube, a single cathode corresponding to red, blue or green fluorescent substance pixel consumes an electrical current at several milliamperes at most. Accordingly, assuming that each conically shaped electron-emitter needs an electrical current of 0.1 microampere, a cathode corresponding to a pixel needs several ten thousands of electron-emitters. If the space between conically shaped electron-emitters is set to be approximately 2 micrometers and the diameter of an electron-emitter is set to be 0.4 millimeters, it is necessary to provide conically shaped electron-emitters at the density of more than $10^5$ electron-emitters per 1 square millimeters.

The foregoing conically shaped electron-emitter is generally made of metal having high melting temperature such as Mo and Ta. However, it is possible to make the conically shaped electron-emitter from silicon semiconductor disclosed in U.S. Pat. No. 4,307,507 issued on Dec. 29, 1981 to Gray et al., which is hereby incorporated by reference to extent that it is consistent herewith.

Figure 6:
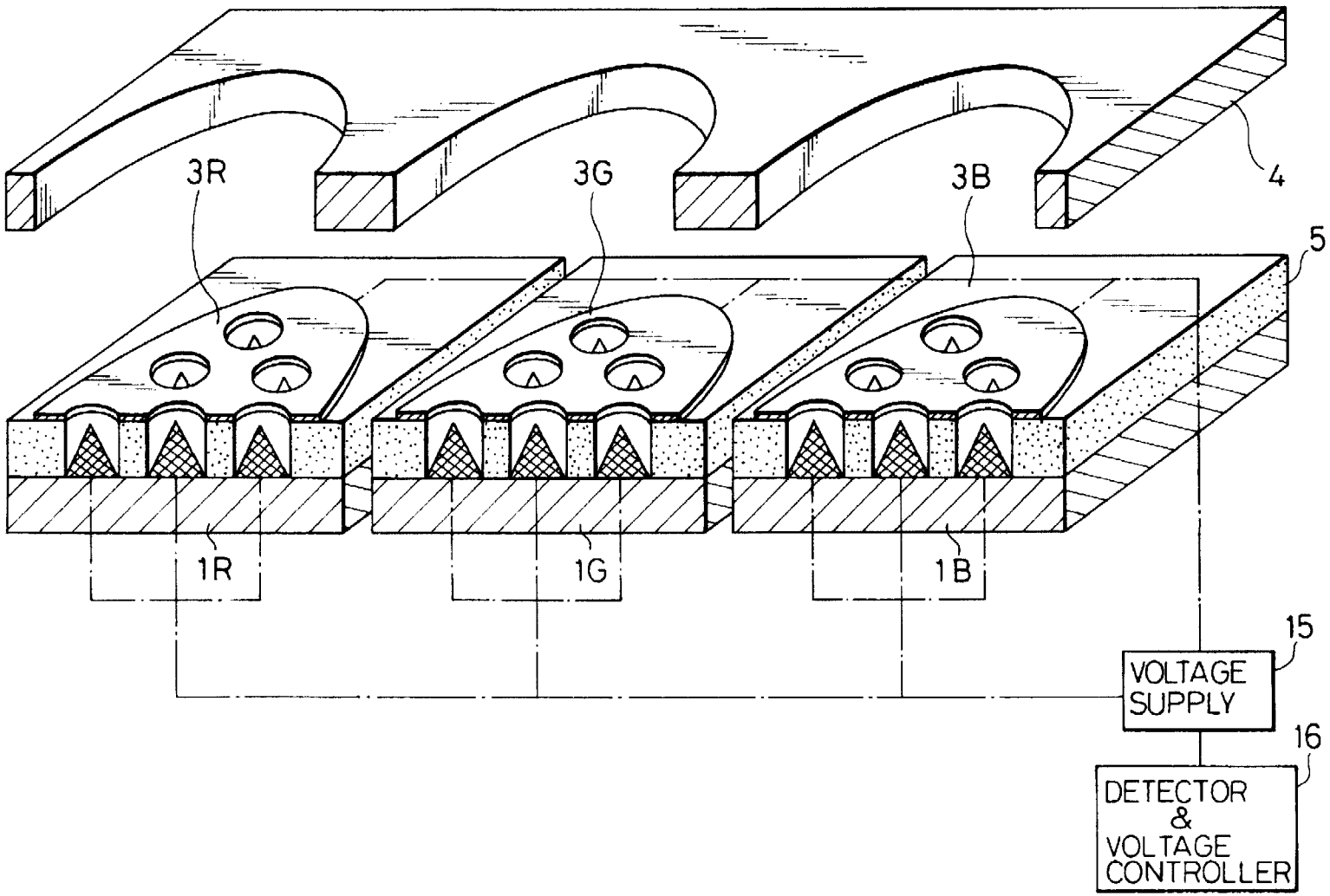
FIG. 6 is a schematic perspective view illustrating a second embodiment in accordance with the invention.

FIG. 6 illustrates a second embodiment of the electron gun in accordance with the invention. In the first embodiment, as illustrated in FIG. 3, the cathodes 1R, 1G and 1B and the gate electrodes 3R, 3G and 3B are formed on a common chip, whereas in the second embodiment each set of the cathode and the gate electrode associated with the cathode is formed on a separate chip. More specifically, a set of the cathode 1R and the gate electrode 3R corresponding to a red pixel is formed on a first chip, a set of the cathode 1G and the gate electrode 3G corresponding to a green pixel is formed on a second chip, and a set of the cathode 1B and the gate electrode 3B corresponding to a blue pixel is formed on a third chip. In FIG. 6, parts corresponding to those of the first embodiment illustrated in FIG. 3 have been provided with the same reference numerals.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. An electron gun with a field emission type cathode and for use with a cathode ray tube, said electron gun comprising:

a substrate;

a plurality of groups of cathodes disposed on said substrate, each group having a plurality of conically shaped electron-emitters;

gate electrodes each associated with a respective group of said plurality of groups of cathodes for causing said conically shaped electron-emitters to emit electrons by field emission;

a voltage supply for applying a cathode control voltage to each group of said plurality of groups of cathodes and a gate control voltage to its respective gate electrode, said cathode control voltages being applied independently to each group of cathodes and said gate control voltages being applied independently to each gate electrode;

a detector for detecting a difference between threshold voltages of each group of cathodes with respect to their respective gate electrodes; and a controller for controlling each of said gate control voltages in accordance with the threshold voltage difference detected by said detector;

wherein said conically shaped electron-emitters are provided in a density equal to or more than about $10^5$ electron-emitters per one square millimeter.

2. An electron gun in accordance with claim 1, wherein said electron gun has three groups of cathodes.

3. An electron gun in accordance with claim 2, wherein a brightness signal for red, green or blue is provided to each of said three groups of cathodes.

4. An electron gun in accordance with claim 1, wherein said plurality of groups of cathodes are electrically insulated from each other.

5. An electron gun in accordance with claim 1, wherein said gate electrodes are electrically insulated from each other.

6. An electron gun in accordance with claim 1, wherein said plurality of groups of cathodes and said gate electrodes are formed on a common single chip.

7. An electron gun in accordance with claim 1, wherein each group of said plurality of groups of cathodes and said gate electrode associated therewith is formed on different chips.

8. An electron gun in accordance with claim 1, wherein each group of cathodes of said plurality of groups of cathodes is sized to have diameter equal to or smaller than approximately 0.4 mm.

9. An electron gun in accordance with claim 1, wherein each group of said plurality of groups of cathodes are sized to be smaller than the diameter of an opening of a control electrode.

10. An electron gun with a field emission type cathode and for use with a cathode ray tube, said electron gun comprising:

a substrate;

a plurality of groups of cathodes disposed on said substrate, each group having one or more conically shaped electron-emitters;

gate electrodes each associated with a respective group of said plurality of groups of cathodes for causing said conically shaped electron-emitters to emit electrons by field emission;

a voltage supply for applying a cathode control voltage to each group of said plurality of groups of cathodes and a gate control voltage to its respective gate electrode, said cathode control voltages being applied independently to each group of cathodes and said gate control voltages being applied independently to each gate electrode;

a detector for detecting a difference between threshold voltages of each group of cathodes with respect to their respective gate electrodes; and a controller for controlling each of said gate control voltages in accordance with the threshold voltage difference detected by said detector;

wherein each of said cathode control voltages applied to said plurality of groups of cathodes is synchronous with and has an opposite phase to its respective gate control voltage.

11. An electron gun with a field emission type cathode and for use with a cathode ray tube, said electron gun comprising:

a substrate;

a plurality of groups of cathodes disposed on said substrate, each group having a plurality of conically shaped electron-emitters;

gate electrodes each associated with a respective group of said plurality of groups of cathodes for causing said conically shaped electron-emitters to emit electrons by field emission;

a voltage supply for applying a cathode control voltage to each group of said plurality of groups of cathodes and a gate control voltage to its respective gate electrode, said cathode control voltages being applied independently to each group of cathodes and said gate control voltages being applied independently to each gate electrode;

a detector for detecting a difference between threshold voltages of each group of cathodes with respect to their respective gate electrodes; and a controller for controlling each of said gate control voltages in accordance with the threshold voltage difference detected by said detector;

wherein said conically shaped electron-emitters each have a diameter equal to or less than approximately one micrometer.

* * * * *